US008752916B2

(12) United States Patent
Kwon et al.

(10) Patent No.: US 8,752,916 B2
(45) Date of Patent: Jun. 17, 2014

(54) REFRIGERATOR

(71) Applicants: Hyokku Kwon, Seoul (KR); Seonkyu Kim, Seoul (KR); Hangbok Lee, Seoul (KR)

(72) Inventors: Hyokku Kwon, Seoul (KR); Seonkyu Kim, Seoul (KR); Hangbok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/628,472

(22) Filed: Sep. 27, 2012

(65) Prior Publication Data

US 2013/0081423 A1 Apr. 4, 2013

(30) Foreign Application Priority Data

Oct. 4, 2011 (KR) ..... 10-2011-0100891

(51) Int. Cl.
*A47B 97/00* (2006.01)
*A47B 88/00* (2006.01)
*A47B 96/04* (2006.01)

(52) U.S. Cl.
USPC ..... 312/292; 312/405.1; 312/313

(58) Field of Classification Search
USPC ..... 312/291, 292, 405, 405.1, 327, 312/313–316; 108/15, 17, 46, 65, 69, 42, 108/44
See application file for complete search history.

(56) References Cited

U.S. PATENT DOCUMENTS

| | | | | | |
|---|---|---|---|---|---|
| 2,062,360 | A * | 12/1936 | Goulooze | ..... | 312/275 |
| 2,095,811 | A * | 10/1937 | Goulooze | ..... | 312/274 |
| 2,112,771 | A * | 3/1938 | Goulooze | ..... | 312/275 |
| 2,122,501 | A * | 7/1938 | Thomas | ..... | 312/242 |
| 2,150,064 | A * | 3/1939 | John et al. | ..... | 62/266 |
| 2,692,813 | A * | 10/1954 | Toronto | ..... | 312/408 |
| 2,767,042 | A * | 10/1956 | Kesling | ..... | 312/313 |
| 2,828,178 | A * | 3/1958 | Dahlgren | ..... | 312/408 |
| 2,942,438 | A * | 6/1960 | Schmeling | ..... | 62/377 |
| 4,306,757 | A * | 12/1981 | Horvay et al. | ..... | 312/292 |
| 5,966,963 | A * | 10/1999 | Kovalaske | ..... | 62/441 |
| 6,401,478 | B2 * | 6/2002 | Dasher et al. | ..... | 62/344 |
| 2011/0187255 | A1 * | 8/2011 | Ryu et al. | ..... | 312/405 |

* cited by examiner

*Primary Examiner* — Darnell Jayne
*Assistant Examiner* — Timothy M Ayres
(74) *Attorney, Agent, or Firm* — KED & Associates LLP

(57) ABSTRACT

A refrigerator is provided that may include a refrigerator body having at least one cooling chamber, and at least one cooling chamber door that opens or closes the at least one cooling chamber. The cooling chamber door may include a first door configured to open or close the at least one cooling chamber, a second door configured to open or close an open portion formed in the first door, and a support provided at the open portion that supports articles or food. The second door may be rotated around a rotational shaft that extends in a substantially vertical direction with respect to the at least one cooling chamber door. With this structure, food may be supported using the support when the second door is opened, thereby facilitating the putting in and taking out of food from the open portion.

12 Claims, 7 Drawing Sheets

REFRIGERATOR

CROSS-REFERENCE TO RELATED APPLICATION(S)

The present application claims priority to Korean Application No. 10-2011-0100891, filed in Korea on Oct. 4, 2011, which is herein expressly incorporated by reference in its entirety.

BACKGROUND

1. Field

A refrigerator is disclosed herein.

2. Background

Refrigerators are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
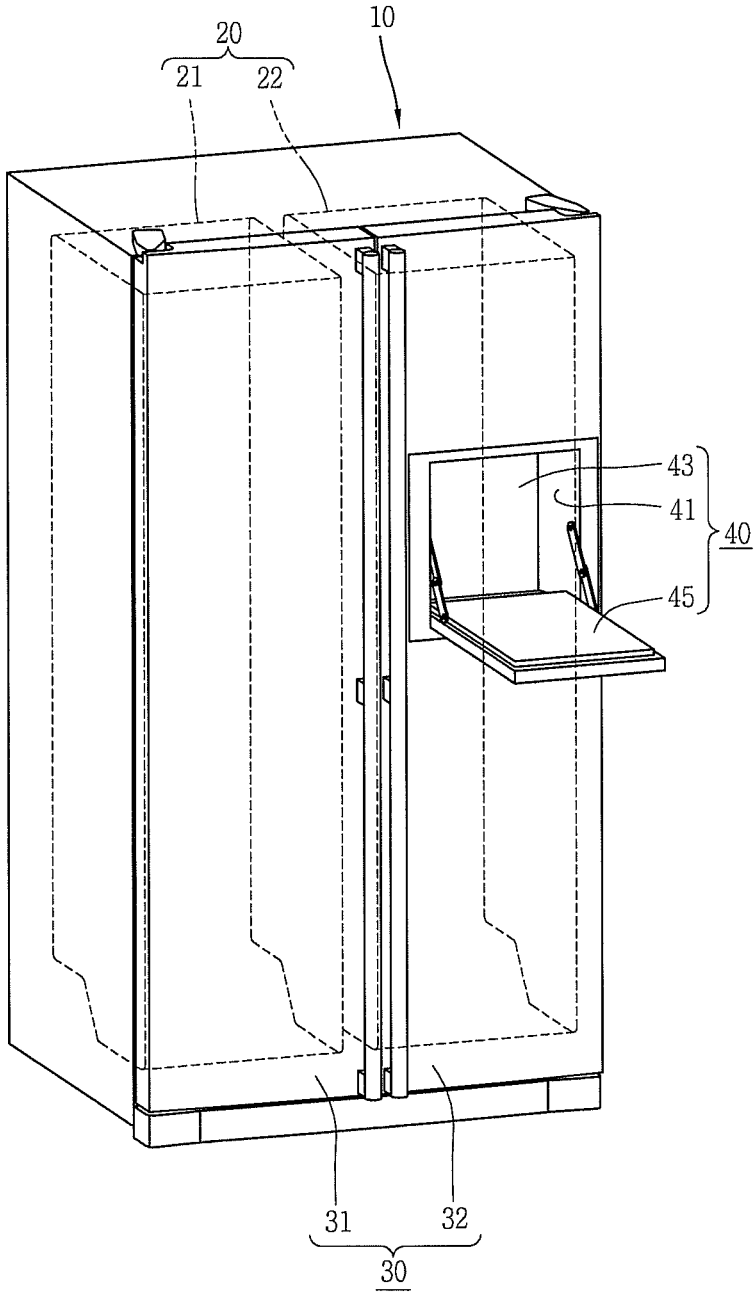
FIG. 1 is a perspective view of a refrigerator according to an embodiment.

Hereinafter, embodiments will be described in detail with reference to the accompanying drawings. Where possible, like reference numerals have been used to indicate like elements.

As is generally known, a refrigerator is a device that stores food in a frozen or refrigerated state to keep it fresh. The refrigerator may include a refrigerator body having a cooling chamber in which food may be accommodated and stored in a cooled state, a door that opens or closes the cooling chamber, and a refrigeration cycle that provides providing cool air to the cooling chamber.

The refrigeration cycle apparatus may include a so-called vapor compression type refrigeration cycle apparatus, for example, including a compressor that compresses refrigerant, a condenser in which refrigerant is dissipated and condensed, an expansion apparatus in which refrigerant is decompressed and expanded, and an evaporator in which refrigerant absorbs and evaporate ambient latent heat.

FIG. 1 is a schematic view of a refrigerator according to an embodiment. The refrigerator of FIG. 1 may include a refrigerator body 10 having a cooling chamber(s) 20, and a door(s) 30 that opens or closes the cooling chamber(s) 20. The refrigerator body 10 may be provided with a refrigeration cycle apparatus (not shown) that provides cool air to the cooling chamber(s) 20.

The cooling chamber(s) 20 may include a freezing chamber 21 and a refrigerating chamber 22. The freezing chamber 21 and refrigerating chamber 22 may be formed along a left/right or horizontal/traverse direction, respectively, in the refrigerator body 10.

The door(s) 30 may include a freezing chamber door 31 that opens or closes the freezing chamber 21 provided at a front surface of the freezing chamber 21, and a refrigerating chamber door 32 that opens or closes the refrigerating chamber 22 provided at a front surface of the refrigerating chamber 22.

A home bar 40 may be provided in the refrigerator to allow food to be taken out of and/or put into the refrigerator without opening the door(s) 30. The home bar 40 may be provided at or in the refrigerating chamber door 32. With this structure, it may be possible to facilitate the putting in and/or taking out of food without directly opening the relatively large door(s) 30, such as the refrigerating chamber door 32. A home bar (not shown) may also be provided at or in the freezing chamber door 31.

An open portion 41, the inside and outside of which may communicate through a plate surface, may be formed at or in the refrigerating chamber door 32. A housing 43 forming a predetermined space may be provided at one side of the open portion 41, for example, at a side of the refrigerating chamber 22.

A home bar door 45 that opens or closes the open portion 41 may be provided at a front surface of the open portion 41. A lower region of the home bar door 45 may be hinge-combined with the open portion 41 of the refrigerating chamber door 32. The home bar door 45 may be rotated in a top/down or vertical direction. The home bar door 45 may be rotated downward to be horizontally disposed when opening the open portion 41. When the home bar door 45 is rotated downward and horizontally disposed, a cup may be placed on an upper surface of the home bar door 45.

However, with such a refrigerator, the home bar door 45 is combined with a lower region of the open portion 41 along the top/down or vertical direction in a rotatable manner, and thus, there is a limit in increasing a size of the home bar door 45. More specifically, when increasing the size of the home bar door 45, a weight of the home bar door 45 may also be increased, and thus, when opening the home bar door 45*a*, impact contact may occur between the home bar door 45 and the open portion 41 when the home bar door 45 is abruptly rotated downward.

Further, a relatively large force may be required during the opening or closing operation due to the increase in size of the home bar door 45, thereby causing inconvenience. Furthermore, with such a refrigerator, the size of the home bar door 45 and open portion 41 may be restricted, and due to this, the putting in and/or taking out of food may be restricted. Additionally, there is provided a structure in which an accommodation space for food cannot be formed at an inner surface of the home bar door 45, and as a result, there is a limit in increasing the size of the accommodation space for food.

Figure 2:
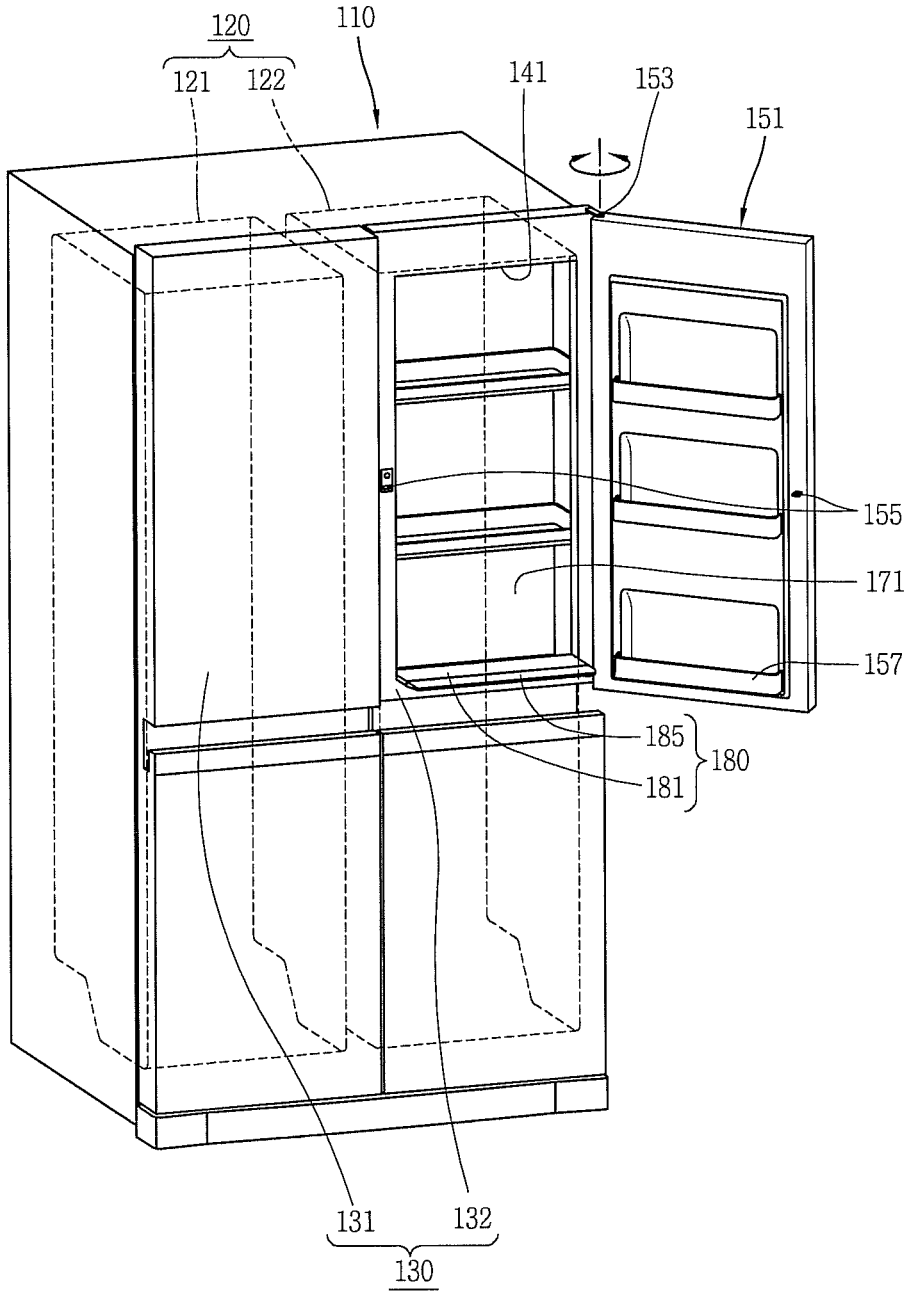
FIG. 2 is a perspective view of a refrigerator according to an embodiment.
Figure 3:
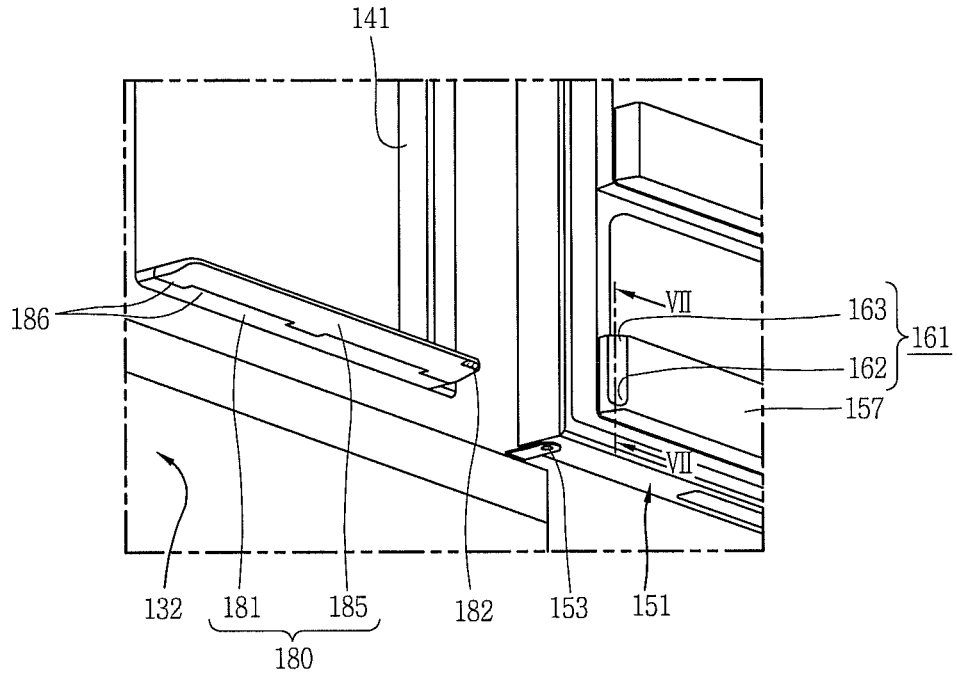
FIG. 3 is a front perspective view of a portion of the refrigerator of FIG. 2, shown with a supplemental or second door open.
Figure 4:
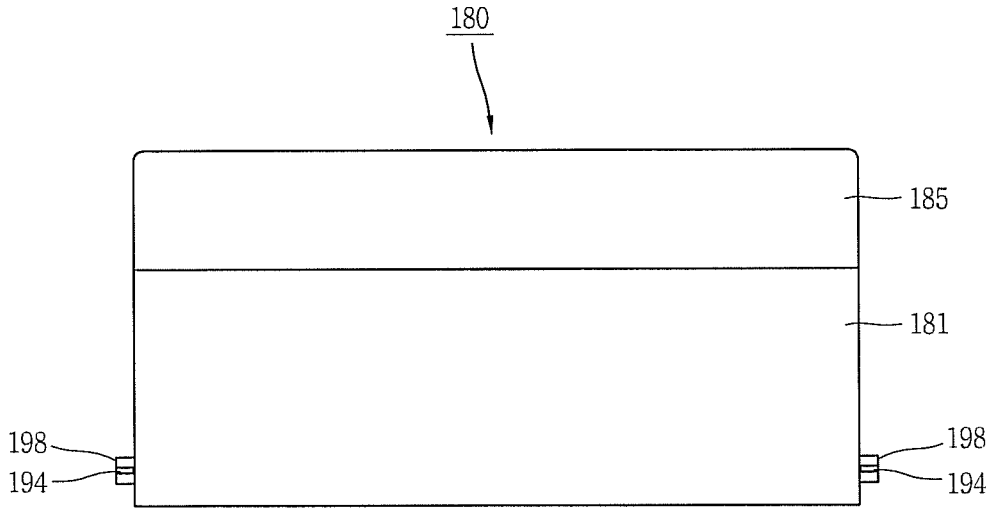
FIG. 4 is a plan view of a support of FIG. 2.
Figure 5:
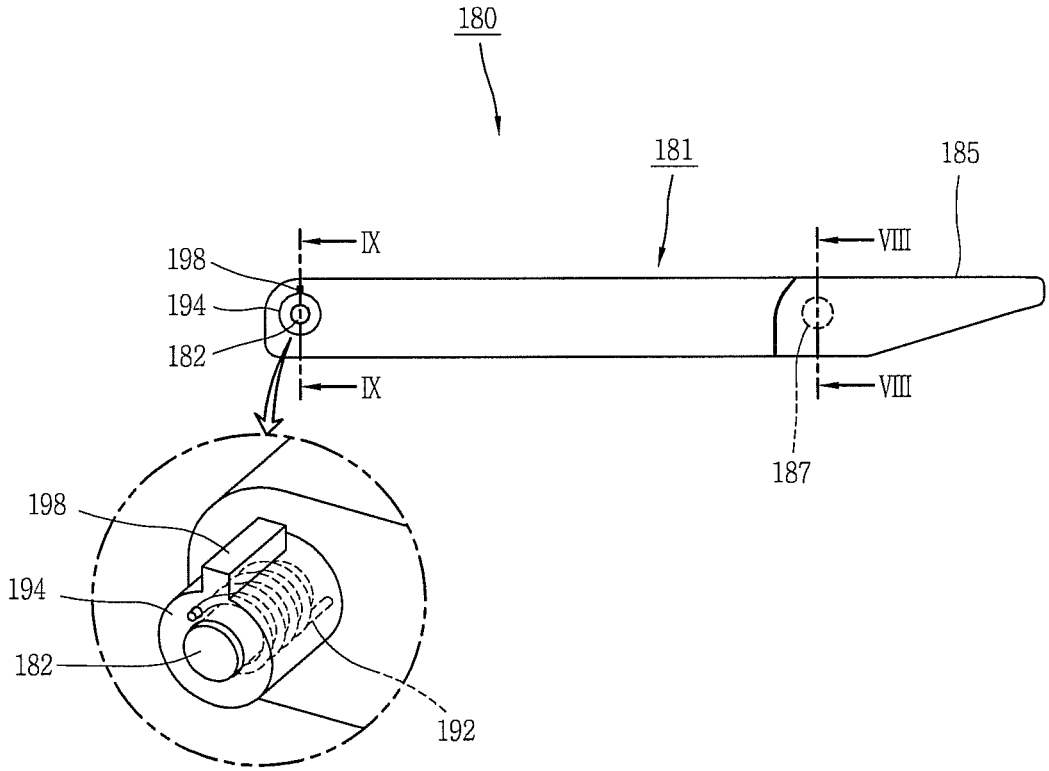
FIG. 5 is a side view of the support of FIG. 2.
Figure 6:
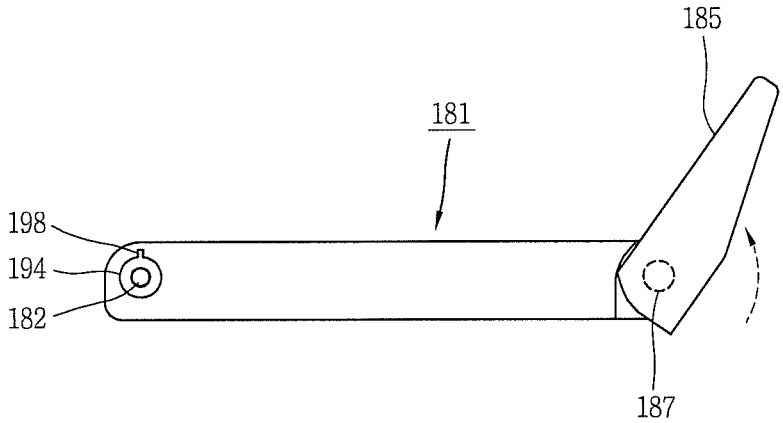
FIG. 6 is a view for explaining operation of the support of FIG. 5.

FIG. 2 is a perspective view of a refrigerator according to an embodiment. As illustrated in FIG. 2, a refrigerator according to this embodiment may include a refrigerator body 110 having a cooling chamber(s) 120 and a cooling chamber door(s) 130 provided with an open portion 141 through which articles or food may be put into or drawn out of the refrigerator. The cooling chamber door(s) 130 may each include a first or primary door 132*a* configured to open or close the cooling chamber 120 and a second or supplemental door 151 configured to open or close the open portion 141, and a support 180 provided at or in the open portion 141 to support articles or food thereon. The supplemental door 151 may be rotated around a rotational shaft 153 disposed along an up/down or vertical direction with respect to the cooling chamber door 130.

The cooling chamber(s) 120 may include a refrigerating chamber 122 and/or a freezing chamber 121. Thus, the refrigerator body 110 may include at least one of the refrigerating chamber 122 and/or the freezing chamber 121. Hereinafter, according to this embodiment, a case will be described in which the refrigerator body 110 includes both a refrigerating chamber 122 and a freezing chamber 121, as an example. Further, according to embodiments, the open portion 141 may be provided at or in a refrigerating chamber door 132 that opens or closes the refrigerating chamber 122, as an example. However, embodiments are not so limited.

As noted above, the refrigerator body 110 may include a plurality of cooling chambers 120 thereinside. The cooling chamber door(s) 130 that opens or closes the cooling chamber(s) 120 may be provided at a front surface of the cooling chamber(s) 120.

The cooling chamber(s) 120 may include the freezing chamber 121 and the refrigerating chamber 122. The freezing chamber 121 and the refrigerating chamber 122 may be disposed along a left/right or horizontal/traverse direction.

The cooling chamber door(s) 130 may include a freezing chamber door 131 and the refrigerating chamber door 132, which opens or closes the refrigerating chamber 122. Further, each chamber door 131, 132 may include a primary door 131*a*, 132*a* and a supplemental door 151.

The open portion 141 may have a predetermined size, and may be formed at or in the refrigerating chamber primary door 132*a*. Articles or food may be put into or taken out through the open portion 141 without opening the refrigerating chamber door 132. Accordingly, food having a relatively high frequency of being taken-out (for example, drinking water, other beverages, such as juice, or liquor, such as beer or wine) may be easily taken out and/or put into the open portion 141 without opening the refrigerating chamber door 132. Further, it may be possible to reduce a frequency of opening the refrigerating chamber door 132, thereby reducing cool air loss occurring when opening or closing the refrigerating chamber door 132 in a relatively large scale.

The open portion 141 may be formed in a rectangular shape, for example. The supplemental door 151, which may open or close the open portion 141, may be provided at a front surface of the open portion 141. For example, the supplemental door 151 may be configured to open or close the open portion 141 while rotating around a rotational shaft 153 disposed along an up/down or vertical direction with respect to the refrigerating chamber door 132. With this structure, the opening or closing of the supplemental door 151 may be easily implemented. Further, even when a size of the supplemental door 151 is increased, the supplemental door 151 may be easily opened or closed by a relatively small force. With this configuration, the size of the open portion 141 and supplemental door 151 may be sufficiently increased, and thus, articles or food may be easily put into and/or taken out of the refrigerator using the supplemental door 151, which may be easily opened or closed with a relatively small force without opening or closing the refrigerating chamber primary door 132*a*, which requires a relatively large force during the opening or closing operation.

The supplemental door 151 may be hinge-combined with one side of the open portion 141 (i.e., right side region on the drawing), for example. Accordingly, the supplemental door 151 may open or close the open portion 141 while rotating in a left/right or horizontal/traverse direction around a right side edge portion of the supplemental door 151.

A door fixing portion 155 that maintains the supplemental door 151 in a closed state may be provided at a mutual contact region between the supplemental door 151 and the open portion 141 or primary door 132*a*. For example, the door fixing portion 155 may include a push button mechanism (not shown) for repeatedly performing locking and releasing functions by operations (sequence) of pressing the supplemental door 151. Due to this, the locking and releasing operations may be easily carried out when opening or closing the supplemental door 151.

A door basket 157 may be provided at or on the supplemental door 151, thereby increasing a size of an accommodation space into which articles or food may be put in and/or taken out without opening or closing the primary door 132*a*. The door basket 157 may be configured to be open upward. Both side portions of the door basket 157 may be combined with the supplemental door 151 in a separable manner. A plurality of door baskets 157 may be provided. The plurality of door baskets 157 may be separated from each other in the up/down or vertical direction at an inner surface of the supplemental door 151.

A housing 171 that forms an accommodation space of a predetermined size partitioned from the refrigerating chamber 122 may be provided at an inner side of the open portion 141. With this structure, it may be possible to suppress release of the cool air of the refrigerating chamber 122 to the outside through the open portion 141 when the supplemental door 151 is opened. A cool air inlet portion (not shown), through which the cool air of the refrigerating chamber 122 may be introduced when closing the supplemental door 151, may be provided at or in the housing 171.

A support 180 that supports articles or food may be provided at or in the open portion 141, to facilitate the putting in and/or taking out of the articles or food through the open portion 141 when the supplemental door 151 is opened. The support 180 may be provided at a lower region of the open portion 141 and may include a flat surface on an upper surface of which the articles or food may be placed or stored. The support 180 may be formed in a rectangular plate shape, for example. A bottom surface of the support 180 may contact with and be supported by a bottom surface of the open portion 141.

The support 180 may be configured to have an area larger than that of a lower surface of the open portion 141. For example, the support 180 may be configured to have a width (front/rear width) larger than that of the lower surface of the open portion 141. Accordingly, the support 180 may protrude from the open portion 141. Thus, an upper surface of the support 180 may be larger than an area of the lower surface of the open portion 141, and thus, placing articles and/or food on the upper surface of the support 180 may be further facilitated.

Additionally, the support 180 may be combined with the open portion 141 in a rotatable manner. More specifically, both end portions of the support 180 may be supported by the lower surface of the open portion 141 in a rotatable manner.

The support 180 may be horizontally disposed at the open portion 141, and thus, disposed at or in a support position to support articles or food when the supplemental door 151 is opened, and rotated upward and withdrawn from the support position when the supplemental door 151 is closed, and thus, disposed at a withdrawn position in an inclined manner with respect to the open portion 141.

The support 180 may be configured to be rotated to the support position by its own weight. In other words, the support 180 may be disposed in an inclined manner with respect to the support position in the withdrawn position, and rotated downward to the support position from the withdrawn position by its own weight.

A support contact portion 161, which may be brought into contact with the support 180 such that the support 180 is withdrawn to the withdrawn position, may be provided at or on the supplemental door 151. Thus, the support 180 may be rotated downward to the support position by its own weight when the supplemental door 151 is opened, and pressed and rotated by the support contact portion 161 when the open portion 141 of the supplemental door 151 is closed, and thus, withdrawn to the withdrawn position. With such structure, it is convenient for a user since he or she is not required to rotate the support 180 in a separate manner.

A slide member 182 may be provided at either one of mutual contact surfaces between the support 180 and support contact portion 161. Thus, contact between the support 180 and the support contact portion 161 may be efficiently carried out. More specifically, the support 180 may be rotated to the support position by its own weight while at the same time opening the supplemental door 151. Further, the support 180 may be pressed by the support contact portion 161 and withdrawn to the withdrawn position when the supplemental door 151 is closed. In other words, the support 180 may be rotated by its own weight or the supplemental door 151 when opening or closing the supplemental door 151, and thus, the user is not required to rotate the support 180 in a separate manner.

Figure 7:
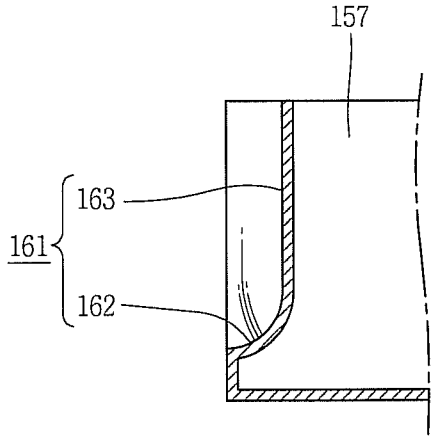
FIG. 7 is a cross-sectional view illustrating a support contact portion of FIG. 5.

The support contact portion 161 may be formed at one side of the door basket 157, as illustrated in FIG. 7. Further, the support contact portion 161 may be depressed toward an inner side of the door basket 157 (i.e., toward an inner space of the door basket 157). The support contact portion 161 may include a press portion 162 disposed to be inclined upward with respect to the support 180 to press the support 180 in the upward direction. More specifically, the support contact portion 161 may be formed in a region corresponding to an outer edge of one side end portion of the support 180.

The support contact portion 161 may be formed at one side edge of the door basket 157 provided at a lower region of the supplemental door 151. At least one region of the press portion 162 may be formed at a lower side of the support 180. For example, the press portion 162 may include an inner concave curved surface (substantially spherical inner surface), so that the support 180 may be easily pressed upward and rotated only by a rotational force of the supplemental door 151 when brought into contact with the support 180.

The support contact portion 161 may include a guide portion 163 that extends upward from the press portion 162 to guide the support 180, so that the support 180 may be easily withdrawn to the withdrawn position. The guide portion 163 may be provided with an inner depressed semi-circular cross section, and may extend upward from one side of the press portion 162.

A damper 192 that exerts resistance to downward rotation of the support 180 may be provided at one side of the support 180. Thus, an abrupt downward rotation of the support 180 may be suppressed, and thus, it may be possible to suppress damage and noise due to impact contact between the support 180 and the open portion 141.

Figure 8:
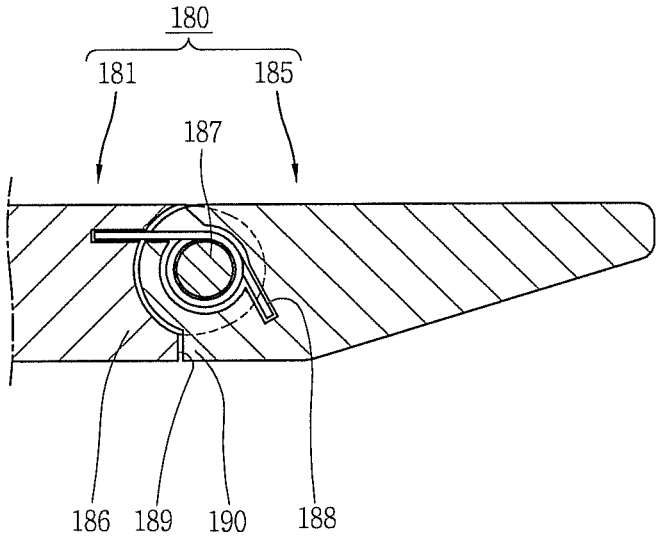
FIG. 8 is a cross-sectional view taken along line VIII-VIII of FIG. 5.
Figure 9:
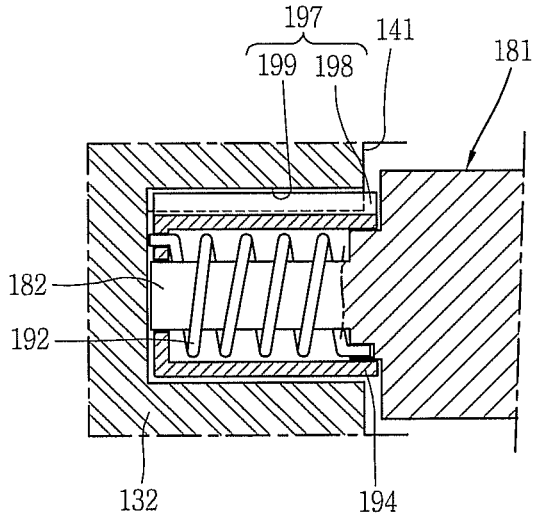
FIG. 9 is a cross-sectional view taken along line IX-IX of FIG. 5.

The damper 192 may include a spring, as illustrated in FIG. 8. More specifically, the damper 192 may be implemented on a coil spring. The coil spring may be disposed around the rotational shaft 182 of the support 180. One end portion of the coil spring may be fixed to the support 180, and the other end portion thereof may be fixed to the open portion 141. The coil spring may store an elastic force while being compressed along the rotational direction of the rotational shaft 182 during downward rotation of the support 180. The elastic force of the coil spring may be exerted in a direction opposite to the downward rotation of the support 180 to apply resistance to the downward rotation of the support 180, thereby limiting an abrupt rotation of the support 180. Thus, abrupt rotation of the support 180 may be suppressed, and it may be possible to suppress impact contact with the open portion 141.

The damper 192 may be provided at both end portions of the support 180, respectively. A cover 194 may be provided at an outside of the damper 192. The cover 194 may be inserted into the open portion 141, and may be fixed to the open portion 141.

A cover accommodation portion 199, into which the cover 194 may be inserted, may be provided at or in the open portion 141. The cover accommodation portion 195 may be formed on the open portion 141 in an inner depressed manner. A cover fixing portion 197, which may be restrained with respect to a rotational direction, may be provided at or in a mutual contact region between the open portion 141 and the cover 194. For example, the cover fixing portion 197 may include a protrusion 198 that protrudes from either one of the cover 194 or the cover accommodation portion 195, and a protrusion accommodation portion 199 formed at the other to accommodate the protrusion 198. According to this embodiment, the protrusion 198 is formed at an outer surface of the cover 194 and the protrusion accommodation portion 199 is formed at or in the cover accommodation portion 195. An end portion of the coil spring 192 may be fixed to the cover 194.

The support 180 may include a support body 181 disposed at the open portion 141 in a rotatable manner, and an extension portion 185 combined therewith and extended in a widthwise direction of the support body 181.

The support body 181 may have a left/right or traverse width corresponding to a left/right or lateral/traverse width of the open portion 141 and a depth or front/rear width corresponding to a front/rear width of the open portion 141, for example. The extension portion 185 may be combined with one side of the support body 181 in a rotatable manner.

A hinge portion 186 may be provided at a mutual contact region between the support body 181 and the extension portion 185. An elastic member 188 that exerts an elastic force, such that the extension portion 185 is unfolded with respect to the support body 181, may be provided at the hinge portion 186. The elastic member 188 may be implemented, for example, as a twisted coil spring (torsion spring).

A stopper 189 that restricts a rotation range of the extension portion 185 rotated with respect to the support body 181 may be provided at the support body 181. The stopper 189 may restrict the rotation range of the extension portion 185, such that an upper surface of the extension portion 185 and an upper surface of the support body 181 may be disposed on a same plane when the extension portion 185 is unfolded. A locking protrusion 190, which may be brought into contact with the stopper 189, may be provided at the extension portion 185.

Figure 10:
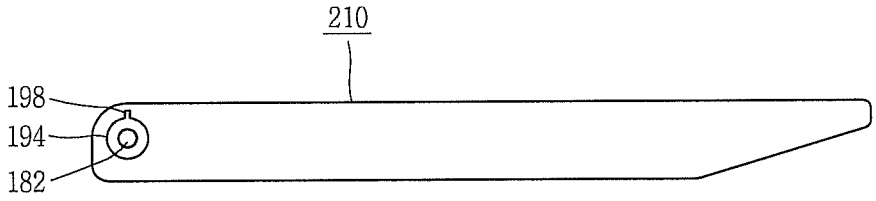
FIGS. 10 through 12 are side views of the support of FIG. 5 according to other embodiments.

Alternatively, as illustrated in FIG. 10, a support 210 may be configured as a single plate-shaped body having a front/rear width larger than that of the bottom surface of the open portion 141.

Figure 11:
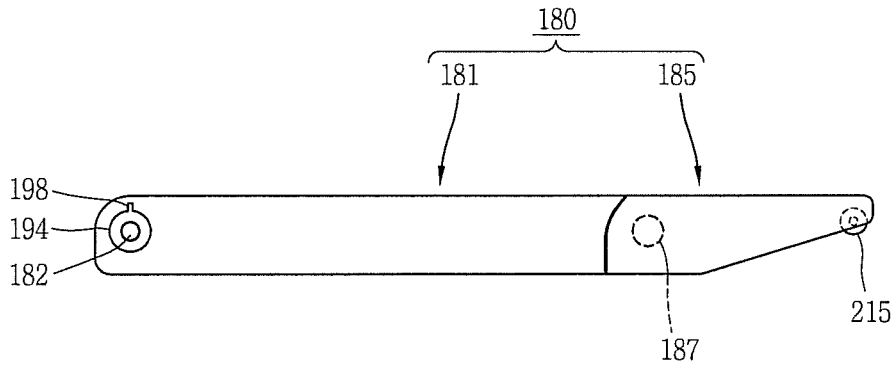
Figure 12:
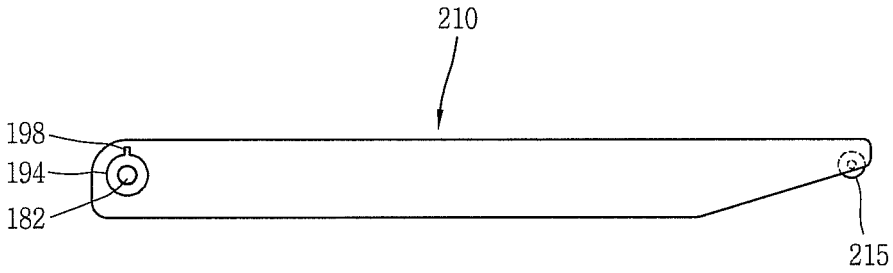

Further, as shown in FIG. 11, the support 180 may include a roller 215, which may provide a sliding contact with the support contact portion 161. More specifically, the roller 215 may be provided at an end portion of the extension portion 185, as illustrated in FIG. 11. With such a configuration, rotation of the support 180 to the withdrawn position may be more efficiently carried out when the supplemental door 151 is closed. Furthermore, as illustrated in FIG. 12, when the support 210 is formed as a single plate shaped body, the roller 215 may be provided at one side edge of the support 210.

With such a configuration, when putting in and/or taking out food without opening the cooling chamber door(s) 130, the supplemental door 151 may be opened by opening the supplemental door 151 in a forward direction. The supplemental door 151 may be rotated in a horizontal direction around the rotational shaft 153, which extends in the up/down or vertical direction, thereby facilitating the opening or closing operation with a small amount of force.

When the supplemental door 151 is opened, the support 180 may be rotated downward by its own weight and moved to the support position. More specifically, the support body 181 may be brought into contact with and supported by a lower surface of the open portion 141, and the extension portion 185 may be extended along a widthwise direction of the support body 181 by means of an elastic force of the elastic member 188. The extension portion 185 may be supported by the support body 181 without being brought into contact with a lower surface of the open portion 141.

Rotation of the extension portion 185 may be suppressed by mutual contact between the stopper 189 and locking protrusion 190, and thus, maintained in a state in which the upper surface thereof is disposed on the substantially same plane as an upper surface of the support body 181. Due to this, it may be possible to easily support food.

On the other hand, the supplemental door 151 may be pressed toward the main door 132*a* in a state in which articles or food are not placed on an upper surface of the support 180, and thus, the open portion 141 may be blocked by the supplemental door 151.

When the rotation of the supplemental door 151 is started in the closing direction, the support contact portion 161 may be brought into contact with the support 180. The press portion 162 may be disposed to be inclined upward with respect to the support 180 and at least one region thereof may be disposed at a position lower than the support 180, and thus, the support 180 may be pressed in the upward direction.

When the support 180 is pressed by the press portion 162, the extension portion 185 of the support 180 may be relatively rotated with respect to the support body 181, as well as an edge of the extension portion 185 may be moved upward along the guide portion 163. The extension portion 185 may be relatively rotated by a pressure of the supplemental door 151, and then the support body 181 may be rotated in the upward direction. When the rotation of the door 151 is completed and the open portion 141 is blocked, the support 180 may be disposed in the withdrawn position.

As described above, according to embodiments disclosed herein, an open portion may be formed at or in a cooling chamber door, and a door that opens or closes the open portion and a support provided at the open portion to support articles or food may be provided, thereby facilitating the putting in and taking out of food. Further, a size of the open portion and door may be relatively increased, thereby facilitating the putting in and taking out of food.

Furthermore, a door basket may be provided at or on the door to increase an accommodation space (or capacity) capable of accommodating food without opening the cooling chamber door, which requires a relatively large force and generates cool air loss. Due to this, it may be possible to put in and take out food without opening or closing the cooling chamber door, thereby enhancing user convenience, and suppressing cool air loss due to opening or closing the cooling chamber door.

Embodiments disclosed herein provide a refrigerator capable of facilitating the putting in and taking out of food. Further, embodiments disclosed herein provide a refrigerator capable of expanding an accommodation space that accommodates food without opening the cooling chamber door.

Embodiments disclosed herein provide a refrigerator that may include a refrigerator body having a cooling chamber, and a cooling chamber door provided with an opening portion to open or close the cooling chamber. The cooling chamber door may include a door configured to open or close the opening portion, and a support unit or device provided at the opening portion to support articles or food. The door may be rotated around a rotational shaft disposed along a top/down direction of the cooling chamber door.

The refrigerator may be configured such that the support unit may be rotated around a rotational shaft disposed along a horizontal direction of the cooling chamber door. The support unit may be disposed at a support position to support articles or food when opening the door, and disposed at a withdrawal or withdrawn position to be withdrawn from the support position when closing the door. Further, a support unit contact portion brought into contact with the support unit to press the support unit in such a manner that the support unit is withdrawn to the withdrawal position may be provided at the door.

The refrigerator may include a door basket provided at the door. The support unit contact portion may be provided at the door basket.

A slide member brought into contact with the support unit contact portion may be provided at the support unit. Further, a roller that can be brought into contact with the door may be provided at the support unit.

The support unit contact portion may include a press portion disposed to be inclined upward with respect to the support unit to press the support unit in the upward direction. The support unit contact portion may be provided with a guide portion extended upward from the press portion to guide the support unit.

The support unit may include a support unit body disposed to be revolved at the opening portion, and an extension portion extended and combined with the support unit body in the width direction thereof. The extension portion may be relatively revolved or rotated with respect to the support unit body. The refrigerator may further include a damping unit configured to exert resistance to the revolution of the support unit. The damping unit may include a spring. The damping unit may be provided at a revolution or rotational shaft of the support unit, and a cover that accommodates the revolution shaft and the damping unit therein may be provided at an outside of the revolution shaft.

As described above, specific embodiments are illustrated and described herein with reference to the accompanying drawings. However, embodiments may be variously implemented without departing from the spirit or gist of the invention, and thus, the foregoing embodiments should not be limited to the content of the detailed description.

Further, the foregoing embodiments should be broadly construed within the scope of the technical spirit defined by the appended claims even though they are not specifically disclosed in the detailed description herein. Moreover, all changes and modifications within the technical scope of the claims and the equivalent scope thereof should be construed to be included in the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a refrigerator body having at least one cooling chamber; and at least one cooling chamber door configured to open and close the at least one cooling chamber, wherein the at least one cooling chamber door comprises:

a first door configured to open and close the at least one cooling chamber;

a second door configured to open and close an open portion formed in the first door; and a support provided at or in the open portion to support articles or food, wherein the second door is rotatable around a rotational shaft that extends in a substantially vertical direction with respect to the at least one cooling chamber door, wherein the support is rotatable around a rotational shaft that extends in a substantially horizontal direction with respect to the at least one cooling chamber door, wherein the support is disposed in a support position to support articles or food when the second door is open, and in a withdrawn position when the second door is closed, and wherein the support comprises:

a support body rotatably provided at or in the open portion;

an extension portion that extends from the support body, wherein the extension portion is configured to rotate with respect to the support body; and a hinge portion provided at a mutual contact region between the support body and the extension portion, wherein the hinge portion comprises an elastic member that exerts an elastic force, such that the extension portion is unfolded with respect to the support body.

2. The refrigerator of claim 1, further comprising a support contact portion, which is brought into contact with the support to press the support such that the support is withdrawn to the withdrawn position, provided on the second door.

3. The refrigerator of claim 2, further comprising at least one door basket provided on the second door.

4. The refrigerator of claim 3, wherein the support contact portion is provided on the at least one door basket.

5. The refrigerator of claim 2, wherein the support further comprises a slide member configured to be brought into contact with the support contact portion.

6. The refrigerator of claim 2, wherein the support further comprises a roller configured to be brought into contact with the second door.

7. The refrigerator of claim 2, wherein the support contact portion comprises a press portion inclined upward with respect to the support to press the support in an upward direction.

8. The refrigerator of claim 7, wherein the support contact portion further comprises a guide portion that extends upward from the press portion and guides the support.

9. The refrigerator of claim 1, further comprising:

a damper configured to exert a resistance to the rotation of the support.

10. The refrigerator of claim 9, wherein the damper comprises a spring.

11. The refrigerator of claim 10, wherein the damper is provided at a rotational shaft of the support.

12. The refrigerator of claim 11, further comprising a cover that accommodates the rotational shaft and the damper therein.

* * * * *